US005832538A

United States Patent [19]

Williams

[11] Patent Number: 5,832,538

[45] Date of Patent: Nov. 10, 1998

[54] PROTECTIVE HEADWEAR

[76] Inventor: Kevin S. Williams, 3512 Bertrand, Dallas, Tex. 75210

[21] Appl. No.: 815,643

[22] Filed: Mar. 13, 1997

[51] Int. Cl.[6] ..... A42B 1/06

[52] U.S. Cl. ..... 2/202; 2/172; 2/204; 2/205; 2/200.1

[58] Field of Search ..... 2/172, 202, 204, 2/205, 195.2, 200.1, 209.13, 417, 418, 419

[56] References Cited

U.S. PATENT DOCUMENTS

| | | | |
|---|---|---|---|
| D. 331,297 | 11/1992 | Herod . | |
| 2,446,530 | 8/1948 | De Grazia et al. . | |
| 2,971,198 | 2/1961 | Tomich . | |
| 3,561,010 | 2/1971 | Little . | |
| 3,696,474 | 10/1972 | Slauta . | |
| 3,698,014 | 10/1972 | Little et al. . | |
| 5,339,466 | 8/1994 | McMullen . | |
| 5,369,809 | 12/1994 | Hall | 2/202 |
| 5,575,009 | 11/1996 | Ryvin | 2/202 |

FOREIGN PATENT DOCUMENTS

| | | | |
|---|---|---|---|
| 94689 | 9/1959 | Norway | 2/202 |

*Primary Examiner*—Diana Biefeld
*Attorney, Agent, or Firm*—Richard C. Litman

[57] ABSTRACT

A head covering device including a hood portion and a detachable cover for covering the head, neck and upper back from the sun. The hood portion is formed of an absorbent inner layer of material and a porous outer layer of material which together function to shade the wearer, conserve body water, and allow for cooling the wearer by evaporation of perspiration. Fasteners are provided for removably attaching the cover to the hood portion. A channel is provided which extends through a crown portion of the hood and receives a cord whose ends are adjustably connectable for securing the hood portion onto the wearer's head. Another channel provided along a lower edge of the hood portion receives a cord whose ends are adjustably connectable for gathering the hood portion about the neck of the wearer.

14 Claims, 3 Drawing Sheets

FIG. 3
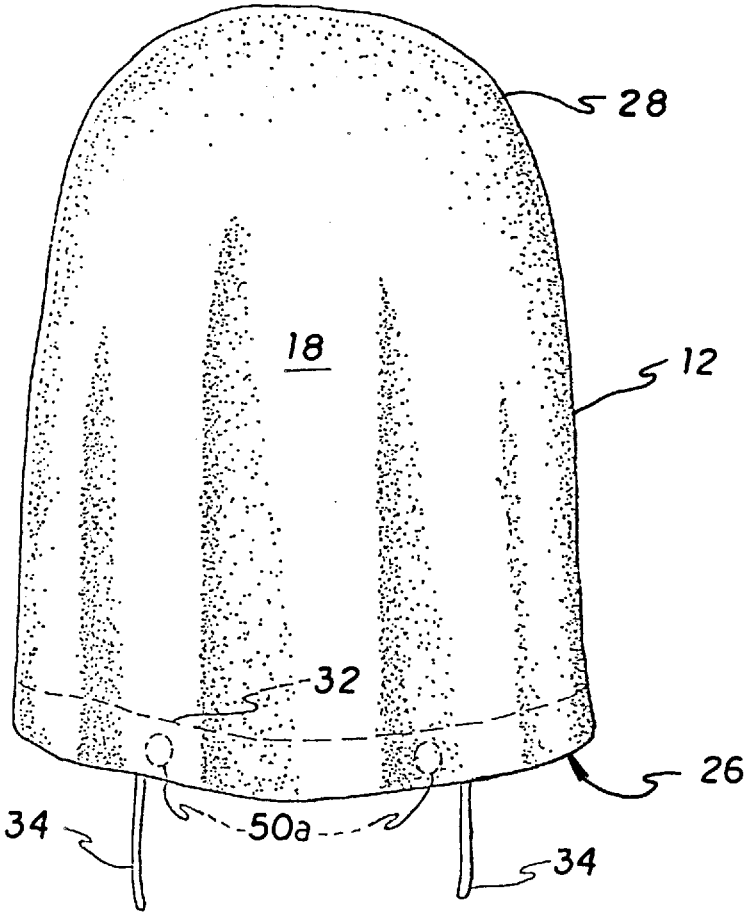
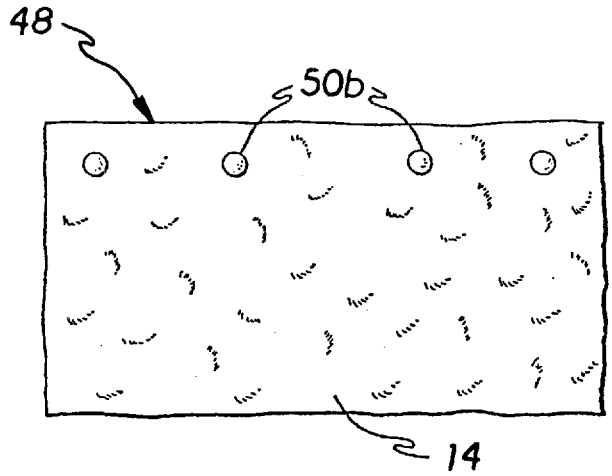
FIG. 4

PROTECTIVE HEADWEAR

CROSS-REFERENCE TO RELATED APPLICATION

This application claims the benefit of U.S. Provisional patent application Ser. No. 60/021,446, filed Jul. 10, 1996.

BACKGROUND OF THE INVENTION

1. Field of the Invention

The present invention generally relates to headwear. More specifically, the present invention relates to protective headwear for covering the head, neck, and upper back to protect a wearer against overexposure from the sun.

2. Description of Relevant Art

Exposure to the sun has been shown to have more deleterious effects than salubrious effects. Repeated and/or prolonged exposure to the sun is not only responsible for skin cancers and painful burns, but the combination of sun and dry heat can result in dehydration and possibly sunstroke. Unfortunately, not everyone can avoid the sun and associated extreme temperature conditions, so a protocol for working in the sun must be achieved. The most important objective for such a protocol is protection of the skin from the direct radiation of the sun, and another important objective is the conservation of body fluids. A third objective is simply keeping cooler than the ambient temperature. Generally, hot air has a reduced relative humidity, which permits evaporation of water until the relative humidity reaches 100%. Associated with the evaporation of water is a physical process of heat absorption equal to the heat of vaporization of water at the ambient temperature and pressure. This is a large caloric value, and when that heat of vaporization is supplied partially by the skin, a person experiences a cooling effect.

One strategy for achieving the above-described objectives is to utilize proper clothing. For example, the heavy white robes of desert nomads achieve the objectives of shading the skin, conserving body fluids, and cooling the body by slow evaporation of perspiration from the apparel. However, such a desert robe is impractical for outdoor laborers, and excessive for the intended purposes of the invention.

The relevant art contains a number of head covering hoods. U.S. Pat. No. Des. 331,297, issued to Herod on Nov. 24, 1992, discloses a head covering hood having a portion which covers the head and neck, and an movable portion which optionally and partially covers the face (i.e., the nose, mouth and cheeks).

U.S. Pat. No. 2,446,530, issued to De Gracia et al. on Aug. 10, 1948, discloses a hood for covering the head and neck and intended to be used in conjunction with a gas mask. The hood includes a forehead portion which is split and provided with a gusset and a fastener, which renders the hood expandable for placement over a gas mask.

U.S. Pat. No. 2,971,198, issued to Tomich on Feb. 14, 1961, discloses a combination rain cape and hood which may be folded for storage of the cape portion within the hood portion.

U.S. Pat. No. 3,561,010, issued to Little on Feb. 9, 1971, discloses a convertible head covering having a face opening and a panel spaced rearwardly of the opening and stitched to the inner surface of the head covering. The head covering may be worn with the panel adjacent the rear portion of the hood, thus leaving the face of the wear exposed, or the panel may be spaced from the rear portion to close the face opening and to cover the face of the wearer.

U.S. Pat. No. 3,696,474, issued to Slauta on Oct. 10, 1972, discloses a lacing lock for use on a hood of the type having an opening which is adjustable by adjustment of the lacing that passes through the hood.

U.S. Pat. No. 3,698,014, issued to Little et al. on Oct. 17, 1972, discloses a combination jacket and hood in which the hood is attached to the neckline of the jacket by a strip of flexible fabric which permits the hood to move relative to the jacket.

U.S. Pat. No. 5,339,466, issued to McMullen on Aug. 23, 1994, discloses a cold weather sleeping hood intended for use in conjunction with a sleeping bag. The hood includes a head covering portion having an adjustable opening for variable exposure of the face, and an integral second portion which covers the upper chest, upper back and shoulders.

None of the above inventions and patents, taken either singularly or in combination, is seen to describe the instant invention. Thus, a protective head covering solving the problem of shading the skin, cooling the body, and conserving body fluids is desired.

SUMMARY OF THE INVENTION

Accordingly, it is a principal objective of the invention to provide a protective head covering for protecting the head, neck, and upper back from the sun by shading, reflecting the radiation, conserving body fluids, and cooling the wearer's head, neck and upper back by evaporation of water retained in the pores of the hood fabric.

It is another objective of the invention to provide such protection from the sun in a convenient and lightweight head covering with a detachable cover for the neck and the upper back.

It is a further objective of the invention to provide a protective head covering having a detachable cover which can be used as a towel.

The head covering of the present invention includes a white colored hood with a detachable cover made from terry cloth material or equivalent material. The white material of relatively high albedo or reflective value assures that most of the solar energy is not absorbed. The liquid absorption quality of the selected fabric, i.e., terry cloth, permits the retention of perspiration as well as the breathing necessary to assure evaporative cooling. The small, capillary-like pores of a fabric has a chromatographic effect which causes the gaseous vapor to partially recondense, increasing the wetting action. In addition, the porosity acts like a sponge in retaining fluid for evaporation which is wicked towards the outer surface. Also because of the porosity of the material, a greater interface of retained liquid to air is obtained. Appropriate design of the hood assures the necessary shading from the sun, especially for those persons who are shirtless or wearing tank top shirts. The detachable terry cloth cover can conveniently be used as a towel. The aforementioned protocol objectives to protect from heat prostration are thereby achieved.

The hood portion has a front edge thereof which defines a facial opening and includes a first end and a second end which generally hang below the wearer's chin when the hood portion is worn. Extending between the first end and second end of the front edge is a lower edge, and opposite the lower edge (i.e., at the apex of the hood portion) is an integral crown portion which is disposed generally to cover the scalp and specifically the crown of the wearer's head. The lower edge is provided with a hem that defines a first channel formed along the entire length of the lower edge with its opposed open ends near the front edge. Seated inside the first channel is a cord which is freely slidable therein for its adjustment so that its free ends may be adjustably connected together for gathering the first and second ends of the front edge beneath the chin of the wearer. In the preferred embodiment, a second channel with opposed open ends is formed between the inner and outer shells and extends from a position adjacent the front edge at the first end thereof, diagonally over the crown portion to a position adjacent the front edge at the second end thereof. Seated inside the second channel is a cord which is freely slidable therein for its adjustment so that its free ends may be adjustably connected together beneath the chin of the wearer for retaining the hood portion on the head of the wearer.

The detachable cover may be removably attached to the hood portion to allow exposure and coverage of the affected body regions as desired by the wearer. The detachable cover is preferably formed of an absorbent material, such as the same type of material used to form the inner shell. To removably attach the hood portion and cover together, a plurality of first fasteners are secured about the lower edge of the hood portion in a spaced configuration and, in a corresponding spaced configuration, a plurality of second fasteners are provided along one edge of the detachable cover.

It is therefore an objective of the invention to provide improved protective headwear for the purposes described which is inexpensive, dependable and fully effective in accomplishing its intended purposes.

These and other objectives of the present invention will become readily apparent upon further review of the following specification and drawings.

BRIEF DESCRIPTION OF THE DRAWINGS

FIG. 3 is a rear elevational view of a protective hood according to the present invention without the neck and lower back cover.

FIG. 4 is a rear view of the detachable cover for the protection of one's neck and lower back.

Similar reference characters denote corresponding features consistently throughout the attached drawings.

DETAILED DESCRIPTION OF THE PREFERRED EMBODIMENTS

Figure 1:
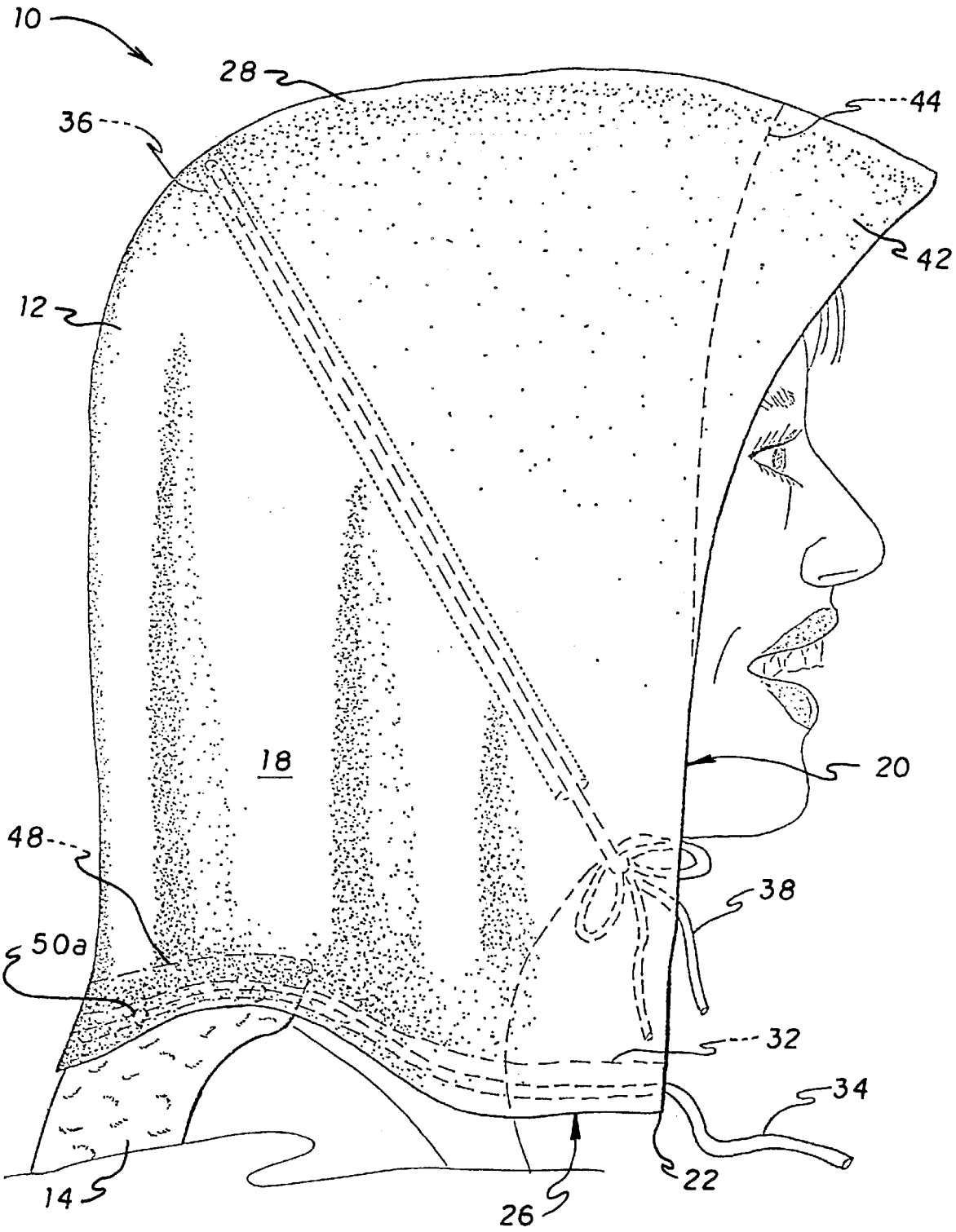
FIG. 1 is a side elevational view of a protective hood and detachable cover according to the present invention, further showing alternative draw string constructions for retaining the covering on the wearer's head.
Figure 2:
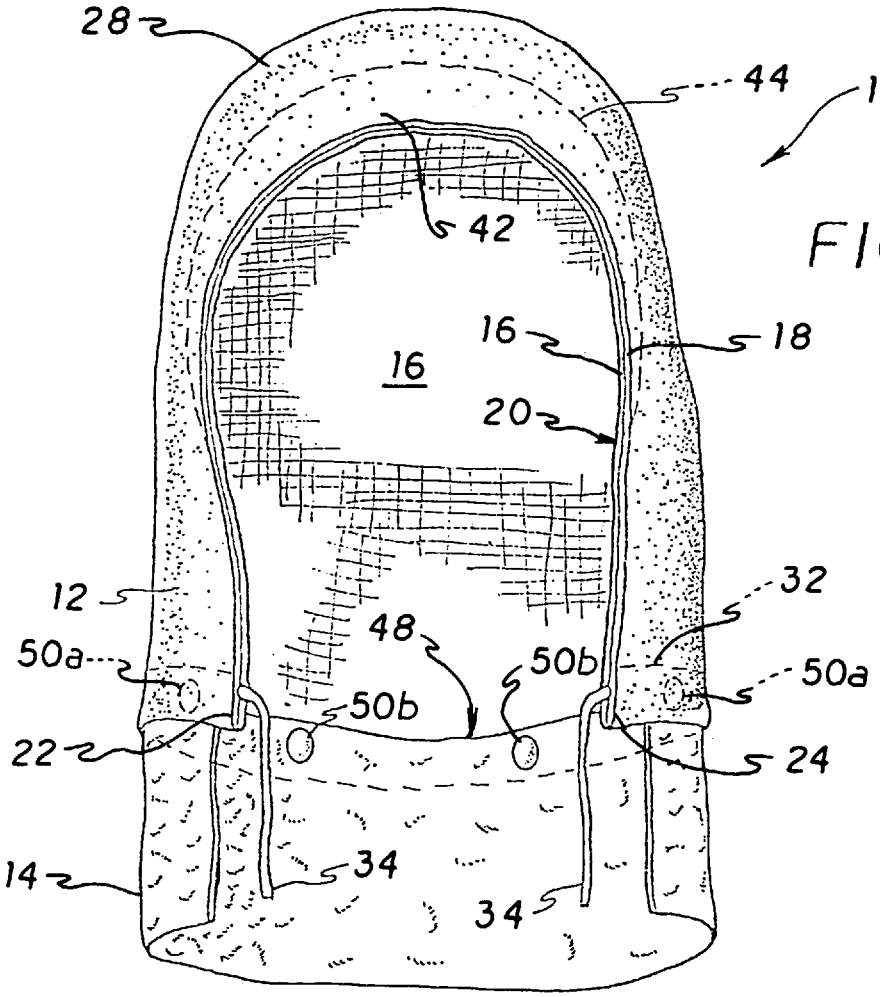
FIG. 2 is a front elevational view of a protective hood and the detachable cover according to the present invention.

Referring now to the figures by numerals of reference and first to FIGS. 1–3, the present invention is a head covering device 10 which generally comprises a hood portion 12 and optionally a detachable cover 14. The head covering device is disposed for protecting the wearer from the ravages of the sun. The cut of the head covering device is proportioned to conform to the shape of the scalp at the top, but is resilient and broadens out at the shoulder to assure protection of the neck from sun exposure. Additional protection is afforded by the detachable cover 14, which is removably attached to the lower edge of the hood for covering the upper back.

The hood portion 12 includes an inner shell 16 and an outer shell 18. The inner shell 16 is preferably formed of an absorbent material which may comfortably be worn against the skin and scalp. Typical absorbent material of the type described includes terry cloth, a pile fabric, usually of cotton, with uncut loops on one or both sides. The outer shell is preferably formed of a porous material that has a high reflectivity. Typical porous materials include various woven nylon or polymer fabrics which are "breathable" or allow for unidirectional or bidirectional movement of vapor through the material. Such fabrics are readily available under a variety of different tradenames from their respective manufacturers.

As shown in FIG. 1, the hood portion 12 is worn by a wearer so that a front edge 20 thereof defines a facial opening. The front edge 20 includes a first end 22 and a second end 24 which generally hangs below the wearer's chin when the hood portion is worn. The first end 22 is visible in FIG. 1, while the second end 24 is shown in FIG. 2. Extending between the first end 22 and second end 24 of the front edge 20 is a lower edge 26. Opposite the lower edge 26 (i.e., at the apex of the hood portion) is an integral crown portion 28 which is disposed generally to cover the scalp and specifically the crown of the wearer's head.

The lower edge 26 is provided with a hem that defines a first channel 32 formed along the entire length of the lower edge and extending between the first and second ends 22, 24 of the front edge 20. The first channel 32 is provided with opposed open ends which, as shown in FIG. 2, are open along a portion of the front edge 20 adjacent the respective first and second ends 22, 24. Although not shown, the open ends of the first channel 32 may be recessed slightly from the front edge, as desired for optimal use and/or manufacture of the headwear. Seated, inside the first channel 32 is a cord 34 which is freely slidable therein for its adjustment. The cord 34 includes opposed, free ends thereof which extend from the respective open ends of the first channel 32. The free ends of the cord 34 are disposed to be adjustably connectable, either by simply tying the free ends together or with the use of conventional connecting mechanisms, for gathering the first and second ends 22, 24 of the front edge together beneath the chin of the wearer. The gathering of the first and second ends 22, 24 ensures adequate coverage of the neck region while the hood portion 12 is worn.

In the preferred embodiment, a second channel 36 is formed between the inner and outer shells 16, 18 by stitching or other like means. The second channel 36 extends from a position adjacent the front edge 20 at the first end 22 thereof, diagonally over the crown portion 28 to a position adjacent the front edge at the second end 24 thereof. Referring to FIG. 1, approximately one-half of the second channel 36 is shown in phantom lines with the other half being an approximate mirror of the half shown. The second channel is provided with opposed open ends, whereby one end is located adjacent the front edge 20 near the first end 22 thereof and the other end is located adjacent the front edge near the second end 24 thereof. Seated inside the second channel 36 is a cord 38 which is freely slidable therein for its adjustment. The cord 38 includes opposed, free ends thereof which extend from the respective open ends of the second channel 36. The free ends of the cord 38 are disposed to be adjustably connectable, either by simply tying the free ends together or with the use of conventional connecting mechanisms. When the ends of the cord are connected together beneath the chin of the wearer so that the cord is comfortably tightened for a snug fit, the cord 38 and second channel 36 serve to retain the hood portion 12 on the head of the wearer.

The front edge 20 of the hood portion 12 may optionally contain a brim portion 42 which is either independently connected to the front edge or formed integrally therewith. In the event the brim portion 42 is formed integrally with the front edge 20, the brim 42 may be stiffened with the use of a stiffening member 44 that supports the brim portion to provide adequate coverage of the wearer's face to assure additional shading of the forehead and the face with proper posture relative to the sun. If formed integrally with the front edge 20, the brim portion 42 may be made resilient upon the addition of sizing or elastomer to the brim portion, or by inserting or reinforcing the brim portion with a resilient fabric (not shown).

Referring specifically now to FIGS. 1, 2 and 4, the interaction between the hood portion 12 and the detachable upper back cover 14 is shown. For those persons who enjoy the sun by going shirtless or wearing a tank-top shirt which exposes the neck and upper back regions, the detachable cover 14 may be removably attached to the hood portion to allow exposure and coverage of the affected body regions as desired by the wearer. The detachable cover 14 is preferably formed of an absorbent material, such as the same type of material used to form the inner shell 16. The detachable cover 14 includes a top edge 48. To allow for removably attaching the hood portion 12 and cover 14 together, mating fastener elements are provided near the top edge 48 of the detachable cover 14 and near the lower edge 26 of the hood portion 12. Typical mating fastener elements may include: hook and loop type fasteners, snap fasteners, buttons and button holes, or other conventional fasteners which are well known in the art. Thus, a plurality of first fasteners 50*a* are secured about the lower edge 26 of the hood portion 12 in a spaced configuration. Preferably the first fasteners 50*a* are located on the interior of the hood (on the inner shell 16) so that the first fasteners are not visible when the detachable cover 14 is not in use. This limitation offers purely cosmetic advantages and in no way limits the location of the first fasteners. In a corresponding spaced configuration, a plurality of second fasteners 50*b* are provided along the top edge 48 of the detachable cover 14. When it is desired to attach together the hood portion 12 and the detachable cover 14, the plurality of first and second fasteners 50*a*, 50*b* are matingly engaged to allow the detachable cover to cover the upper back of the wearer while the head covering device 10 is worn. When detached from the hood portion 12, the detachable cover 14 may be used as a towel or for other purposes which the user may desire.

It is to be understood that the present invention is not limited to the embodiments described above, but encompasses any and all embodiments within the scope of the following claims.

I claim:

1. A head covering device comprising:

a hood including an inner shell formed of a first material and an outer shell formed of a second material;

said hood having a front edge defining a facial opening and including a first end and a second end, said hood further having a lower edge extending between said first and second ends of said front edge, and a crown portion opposite said lower edge;

gathering means for gathering said first and second ends of said front edge together below a wearer's face;

a cover formed of a third material; and removable fastening means for fastening said cover to said hood, said removable fastening means including:

a plurality of spaced first fasteners secured to said hood adjacent said lower edge thereof; and a plurality of second fasteners secured to said cover, each said second fastener being adapted to mate with one of said first fasteners, said plurality of second fasteners being spaced and configured to mate with said plurality of spaced first fasteners on said hood.

2. The head covering device according to claim 1, wherein said hood further includes an integral brim portion formed along said front edge adjacent said crown portion.

3. The head covering device according to claim 1, wherein said first material is an absorbent material.

4. The head covering device according to claim 1, wherein said second material is a porous light-reflective material.

5. The head covering according to claim 1, wherein said lower edge of said hood includes a hem extending substantially from said first end of said front edge to said second end of said front edge, said hem defining a first channel; and said gathering means comprising:

(1) said first channel, said first channel having opposed open ends, one open end of said first channel being adjacent said front edge and said first end thereof and the other open end of said first channel being adjacent said front edge and said second end thereof; and (2) a first cord passing through said first channel with opposed free ends extending from each said open end of said first channel, said opposed free ends of said first cord being adjustably connectable beneath a wearer's face to gather together said first and second ends of said first edge.

6. A head covering device according to claim 1, wherein said third material is an absorbent material.

7. A head covering device according to claim 1, further comprising retaining means for retaining said hood on a wearer's head.

8. A head covering device according to claim 7, wherein said retaining means comprise:

a second channel formed between said inner shell and said outer shell of said hood and passing through said crown portion, said second channel having opposed open ends, one open end being adjacent said front edge and said first end thereof and the other open end being adjacent said front edge and said second end thereof; and a second cord passing through said second channel with opposed free ends extending from each said open end of said second channel, said opposed free ends of said second cord being adjustably connectable beneath the face of the wearer to retain said hood on a wearer's head.

9. A head covering device comprising:

a hood including an inner shell formed of a first material and an outer shell formed of a second material;

said hood having a front edge defining a facial opening and including a first end and a second end, said hood further having a lower edge extending between said first and second ends of said front edge, and a crown portion opposite said lower edge;

gathering means for gathering said first and second ends of said front edge together below a wearer's face; and retaining means for retaining said hood on a wearer's head, said retaining means including:

a first channel formed between said inner shell and said outer shell of said hood and passing through said crown portion, said first channel having opposed open ends, one open end being adjacent said front edge and said first end thereof and the other open end being adjacent said front edge and said second end thereof; and a first cord passing through said first channel with opposed free ends extending from each said open end of said first channel, said opposed free ends of said first cord being adjustably connectable beneath a wearer's face to retain said hood on a wearer's head.

10. The head covering device according to claim 9, wherein said lower edge of said hood includes a hem extending substantially from said first end of said front edge to said second end of said front edge, said hem defining a second channel; and said gathering means comprising:

(1) said second channel having opposed open ends, one open end of said second channel being adjacent said front edge and said first end thereof and the other open end of said second channel being adjacent said front edge and said second end thereof; and (2) a second cord passing through said second channel with opposed free ends extending from each said open end of said second channel, said opposed free ends of said second cord being adjustably connectable beneath a wearer's face to gather together said first and second ends of said first edge.

11. A head covering device comprising:

a hood comprising an inner shell formed of an absorbent material and an outer shell formed of a porous light-reflective material;

said hood having a front edge defining a facial opening and including a first end and a second end, said hood further having a lower edge extending between said first and second ends of said front edge, and a crown portion opposite said lower edge;

said lower edge of said hood including a hem extending substantially from said first end of said front edge to said second end of said front edge, said hem defining a first channel having opposed open ends, one open end of said first channel being adjacent said front edge and said first end thereof and the other open end of said first channel being adjacent said front edge and said second end thereof;

a first cord passing through said first channel with opposed free ends extending from each said open end of said first channel, said opposed free ends of said first cord being adjustably connectable beneath a face of a wearer to gather together said first and second ends of said first edge;

retaining means for retaining said hood on a wearer's head;

a cover formed of an absorbent material; and fastening means for fastening said cover to said hood.

12. The head covering device according to claim 11, wherein said fastening means comprise removable fastening means for removably fastening said cover to said hood.

13. The head covering device according to claim 12, wherein said removable fastening means comprise:

a plurality of spaced first fasteners secured to said hood adjacent said lower edge thereof; and a plurality of second fasteners secured to said cover, each said second fastener being adapted to mate with one of said first fasteners, said plurality of second fasteners being spaced and configured to mate with said plurality of spaced first fasteners on said hood.

14. The head covering device according to claim 11, wherein said retaining means comprise:

a second channel formed between said inner shell and said outer shell of said hood and passing through said crown portion, said second channel having opposed open ends, one open end being adjacent said front edge and said first end thereof and the other open end being adjacent said front edge and said second end thereof; and a second cord passing through said second channel with opposed free ends extending from each said open end of said second channel, said opposed free ends of said second cord being adjustably connectable beneath the face of the wearer to retain said hood on a wearer's head.

* * * * *